US005599195A

United States Patent [19]

Mitani et al.

[11] Patent Number: 5,599,195

[45] Date of Patent: Feb. 4, 1997

[54] IGNITION PLUG CAP

[75] Inventors: Tetsuya Mitani; Hiromitsu Tsuchiya, both of Susono, Japan

[73] Assignee: Yazaki Corporation, Tokyo, Japan

[21] Appl. No.: 345,419

[22] Filed: Nov. 21, 1994

[30] Foreign Application Priority Data

Nov. 30, 1993 [JP] Japan ..... 5-299883

[51] Int. Cl.[6] ..... H01R 13/533

[52] U.S. Cl. ..... 439/125; 439/485

[58] Field of Search ..... 439/125–128, 439/485

[56] References Cited

U.S. PATENT DOCUMENTS

| | | | |
|---|---|---|---|
| 3,803,529 | 4/1974 | Rohrig et al. | 439/126 |
| 3,914,003 | 10/1975 | Loy | 439/126 |
| 4,671,586 | 6/1987 | DeBolt | 439/126 |
| 5,026,294 | 6/1991 | Hisatomi et al. . | |
| 5,181,856 | 1/1993 | Vente et al. | 439/125 |

*Primary Examiner*—Gary F. Paumen

*Attorney, Agent, or Firm*—Armstrong, Westerman, Hattori, McLeland & Naughton

[57] ABSTRACT

An ignition plug cap having at least a plug cap terminal and a discharge tube as a series gap at one end of a high-tension cord for providing electric high-voltage pulses to an ignition plug in a vehicle, wherein the ignition plug cap further comprises an electrically insulating casing for accommodating the plug cap terminal and the discharge tube, which is formed with heat dissipating means such as a plurality of fins formed on the external surface thereof either in parallel or at right angles with vertical axis of the electrically insulating casing, or they can be simultaneously formed otherwise, apart from a spiral fin and so on. With this construction, heat generated therein is effectively dissipated for controlling a rise of temperature, whereby the components of the ignition plug cap in general will not be readily deteriorated even in long-term severe driving conditions.

1 Claim, 3 Drawing Sheets

IGNITION PLUG CAP

BACKGROUND OF THE INVENTION

1. Field of the Invention

The present invention relates to an improvement in an ignition plug cap for providing electric high-voltage pulses to an ignition plug used in a vehicle and, more particularly, to an ignition plug cap which is capable of providing a constant secure ignition to the ignition plug for a substantially long period.

2. Description of the Prior Art

Heretofore, there has been provided a conventional ignition plug cap applied to an engine, or the like, of a vehicle, a case in point being the one as disclosed in FIG. 5. Here, the ignition plug cap of this type is constructed such that a discharge tube 4 is disposed between a cable terminal 3*a* of a high-tension cord 3 and a connecting terminal 2, which is detachably coupled with a terminal 1*a* of an ignition plug 1, wherein these members are all covered with a casing 5 made of an insulation resin coat to be firmly settled therein. However, it is to be noted that there has also been provided an ignition plug cap which has no discharge tube adopted therein.

In a conventional type ignition plug cap without a discharge tube installed therein a rise of temperature due to the heat conducted from the engine is considered. In the discharge-tube-installed type ignition plug cap, however great care should be taken so as not to generate an excessive rise of temperature since the operation of the discharge tube, itself, generates a great amount of heat, especially when driving on a free way or climbing a continuous rising slope for a substantially long period. Such operation deteriorates the functioning of the ignition plug as a whole, so that some kind of protecting method should be taken into consideration in order to protect the ignition plug from this phenomenon.

SUMMARY OF THE INVENTION

The present invention has been made to solve the above-mentioned problems, and accordingly, it is an object of the present invention to provide an ignition plug cap containing a discharge tube therein in a vehicle, which cap is capable of suppressing a rise of temperature even in severe driving conditions, and is therefore, capable of providing a long-term stable ignition timing control function.

In order to accomplish the above objective, an ignition plug cap according to the present invention is formed such that it contains at least a plug cap terminal and a discharge tube as a series gap at one end portion of a high-tension cord for providing electric high-voltage pulses, wherein the ignition plug cap further comprises an electrically insulating casing for accommodating the plug cap terminal and the discharge tube therein, and is characterized in that the electrically insulating casing is formed with a plurality of fin on the external surface thereof.

Other features and advantages of the invention will be apparent from the following description taken in connection with the accompanying drawings.

DETAILED DESCRIPTION OF THE PREFERRED EMBODIMENTS

In the following, several embodiments of the present invention are described with reference to the accompanying drawings, wherein FIGS. 1 to 4 illustrate perspective views each showing a construction of an ignition plug cap as one embodiment of the present invention.

Figure 5:
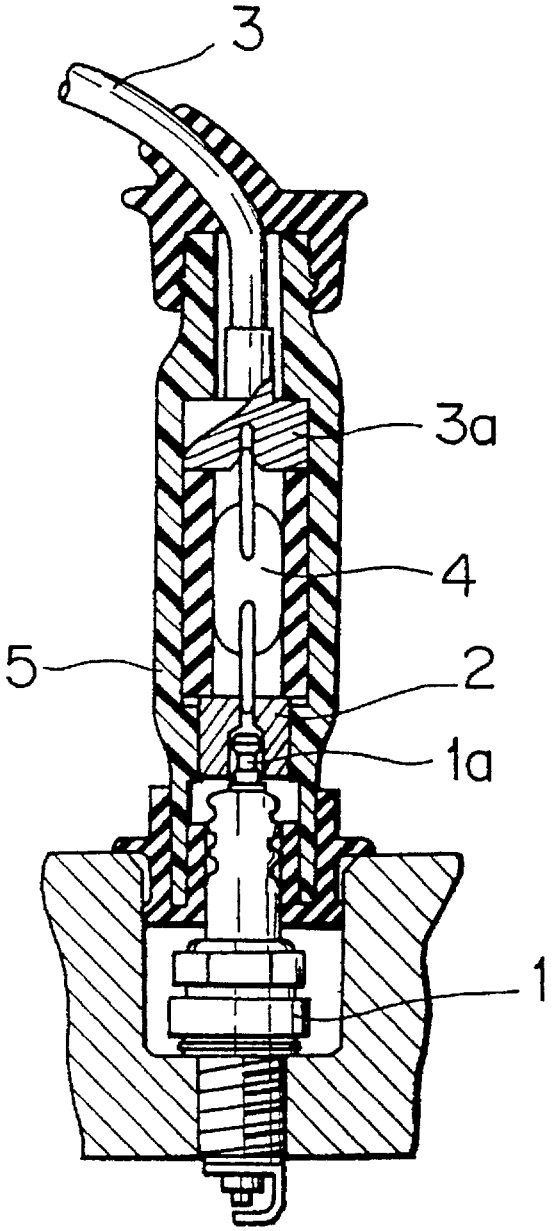
FIG. 5 PRIOR ART
FIG. 5 is a sectional view showing a construction of an ignition plug cap of a conventional device.

It is to be noted that since the construction of the ignition plug cap shown in these figures is essentially the same as the one shown in FIG. 5, except as to the shape of the electrically insulating casing accommodating the functional members, such as a plug cap terminal and a discharge tube, the members having the same functions are denoted by the same or like reference numerals.

Figure 1:
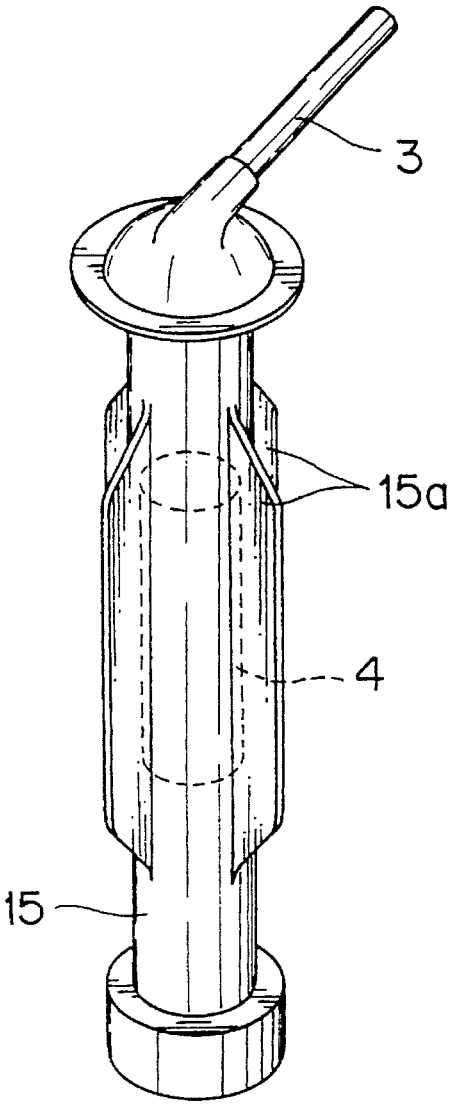
FIG. 1 is a perspective view showing a construction of an ignition plug cap in one embodiment of the present invention.

In FIG. 1, the casing 15 covering the above members according to the present invention is formed with a plurality of ribs 15*a* disposed on the external surface substantially coextensive with the location of the discharge tube inside, and in a parallel relation with respect to the vertical axis for promoting an effective heat dissipation.

Figure 2:
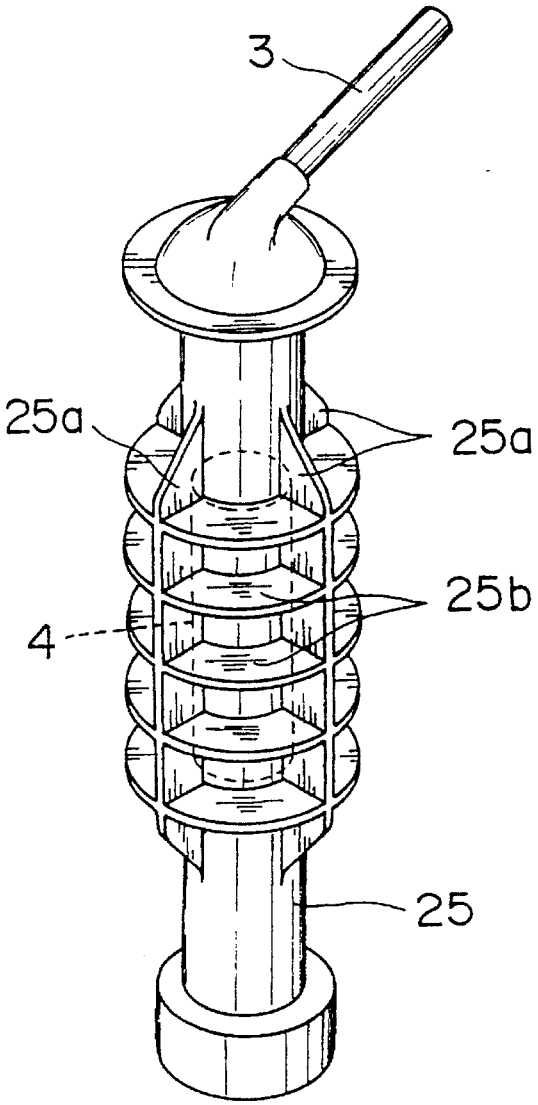
FIG. 2 is a perspective view showing a construction of an ignition plug cap in another embodiment of the present invention.

On the other hand, an ignition plug cap shown in FIG. 2 comprises a casing 25 to cover the functional members, such as a plug cap terminal and a discharge tube, which casing 25 is further formed, not only with fins 25*a*, but also with another type of annular fin 25*b* on the external surface thereof, and also being substantially coextensive with the location of the discharge tube inside. The fins 25*a* and 25*b* are respectively in parallel and vertical relation with respect to the vertical axis of the device, both for promoting equally an effective heat dissipation.

Figure 3:
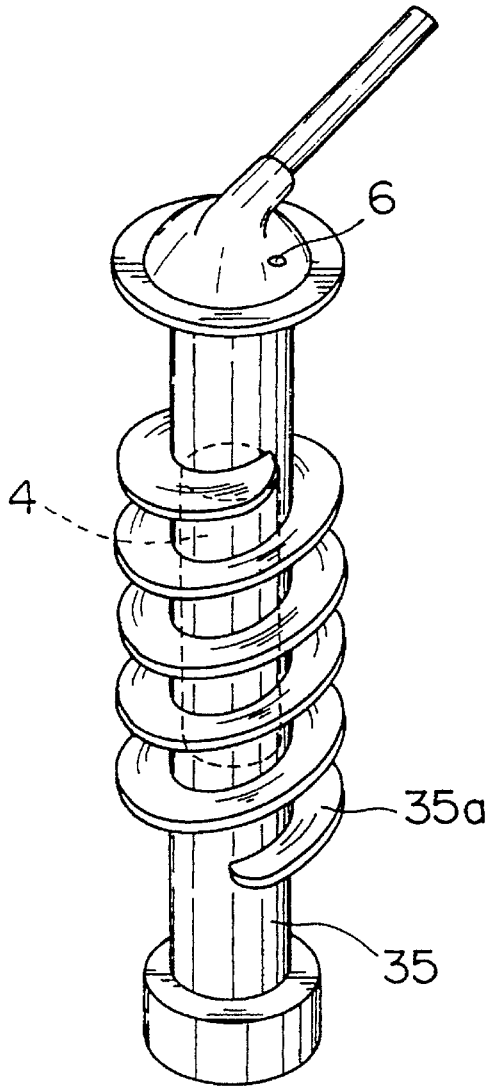
FIG. 3 is a perspective view showing a construction of an ignition plug cap in further embodiment of the present invention.
Figure 4:
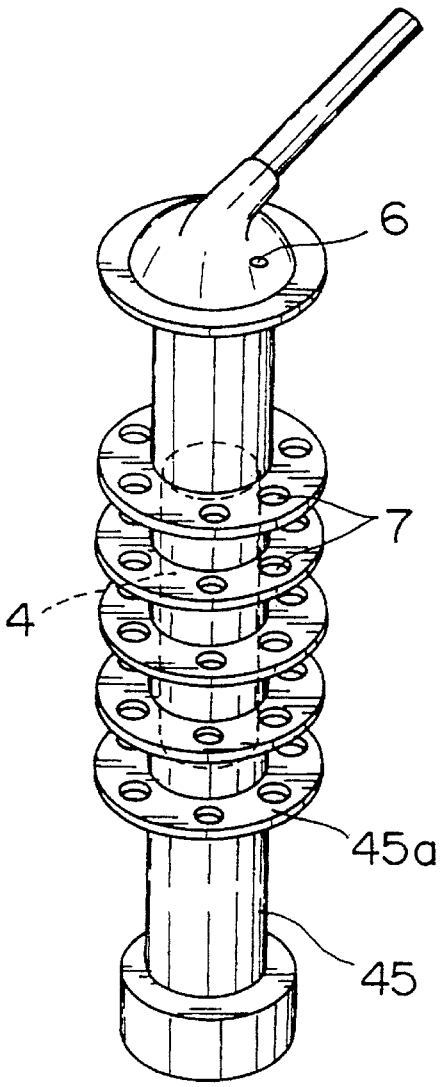
FIG. 4 is a perspective view showing a construction of an ignition plug cap in still further embodiment of the present invention.

FIGS. 3 and 4 show other embodiments of the present invention, wherein in FIG. 3, an ignition plug cap comprises a casing 35, which is further formed with a spiral fin 35*a* on the external surface thereof, and also comprises an air outlet hole 6 at a top end portion of the ignition plug cap for further promotion of effective heat dissipation, while in FIG. 4, an ignition plug cap comprises a casing 45, which is further formed with a plurality of annular fins 45*a* around the external surface thereof, each of which is further formed with a plurality of circular holes 7 therein also for increasing a heat dissipation effect thereof.

[Effect of the Invention]

As explained heretofore, according to the present invention, since functional members, such as a discharge tube and a plug cap terminal, are covered with an electrically insulating casing, which is further formed with various types of fins on the external surface thereof, heat generated from these functional members is effectively dissipated for thereby controlling the rise of temperature, so that the components of the ignition plug cap in general will not be readily deteriorated even in long-term severe driving conditions.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An ignition plug cap having at least a plug cap terminal and a discharge tube disposed in substantially axially aligned, series relation at one end of a high-tension cord for providing high-voltage pulses to an ignition plug, said ignition plug cap further comprising:

an electrically insulating casing for firmly enclosing said plug cap terminal and said discharge tube, said electrically insulating casing being formed with heat dissipating fins having opposed planar surfaces extending radially from the external surface of said casing, said fins extending in a longitudinal direction substantially parallel with the longitudinal axis of said casing to an extent less than the axial length of said casing and being substantially coextensive with the location of said discharge tube within said casing.

* * * * *